US007058993B2

(12) United States Patent
Nasco

(10) Patent No.: US 7,058,993 B2
(45) Date of Patent: Jun. 13, 2006

(54) FLORA INTEGRATED COVER FOR TOILET TOOLS

(76) Inventor: Ronald Nasco, 507 E. Alpine Dr., Payson, AZ (US) 85541

( * ) Notice: Subject to any disclaimer, the term of this patent is extended or adjusted under 35 U.S.C. 154(b) by 0 days.

(21) Appl. No.: 10/634,189

(22) Filed: Aug. 4, 2003

(65) Prior Publication Data

US 2005/0028258 A1 Feb. 10, 2005

Related U.S. Application Data

(63) Continuation-in-part of application No. 10/191,049, filed on Jul. 2, 2002, now abandoned.

(60) Provisional application No. 60/336,618, filed on Dec. 4, 2001.

(51) Int. Cl.
*E03D 9/00* (2006.01)

(52) U.S. Cl. ..... 4/255.11; D6/551; 206/349

(58) Field of Classification Search ..... 4/255.11; D6/524, 551; D31/14; 206/15.3, 349
See application file for complete search history.

(56) References Cited

U.S. PATENT DOCUMENTS

D383,935 S 9/1997 Zawalsky
5,971,141 A 10/1999 Shafik
5,984,100 A 11/1999 Ramsey et al.
D419,806 S 2/2000 Shafik
6,038,709 A * 3/2000 Kent ..... 4/255.05
D457,277 S * 5/2002 Poston ..... D32/14

* cited by examiner

*Primary Examiner*—Charles E. Phillips
(74) *Attorney, Agent, or Firm*—Starkweather & Associates; Michael W. Starkweather; Jason P. Webb

(57) ABSTRACT

A flora integrated cover for a toilet tool, which has a working portion and a handle extending therefrom. The cover comprises a flower pot shaped base, shaped and designed to receive the working portion of the toilet tool, and a flora arrangement, shaped and designed to mount over the handle of the toilet tool. Uniquely, the flora arrangement is in a general appearance of plant leaves. Additionally, the flora arrangement is in a general appearance of a flower arrangement. Also, the flora arrangement is in a general appearance of a combined flower and plant arrangement. The toilet tool may be a toilet bowl brush where the working portion is a brush. The toilet tool may also be a toilet bowl plunger where the working portion is a bell, or suction cup. There also may be a hollow tube, positioned within the flora arrangement to releasably retain the handle within the tube, wherein the hollow tube is fixedly coupled to the flower pot shaped base, and wherein a bottom of the flower pot shaped base is open to allow the flora integrated cover to be placed over, and cover, the toilet tool.

20 Claims, 7 Drawing Sheets

SECTION A-A

FLORA INTEGRATED COVER FOR TOILET TOOLS

CROSS-REFERENCE TO RELATED APPLICATIONS

This application is a continuation-in-part and claims the benefit of U.S. Pat. application Ser. No. 10/191,049, entitled "FLORA INTEGRATED COVER FOR TOILET TOOLS" to Ronald Nasco, and filed on Jul. 2, 2002 now abandoned, and priority to U.S. Provisional Patent Application No. 60/336,618, entitled "FLOWER ARRANGEMENT COVER FOR TOILET BOWL TOOLS, to Ronald Nasco, and filed on Dec. 4, 2001.

BACKGROUND OF THE INVENTION

1. The Field of the Invention

The present invention relates generally to a decorative cover to be placed over a toilet brush, or related toilet tools, for the purposes of hiding the tool(s) within close proximity to a toilet, positively contributing to the aesthetic appearance of a bathroom, and saving space. More particularly, the present invention uses a variety of flora arrangements, including general plant and flower arrangements, and a base resembling a flower pot, which are designed to fit securely over and around a toilet tool, such as a toilet brush or plunger.

2. The Background Art

Toilet maintenance and cleaning tools, especially toilet brushes and plungers, are widely recognized and utilized as essential to the proper care of toilets. Often, these tools are placed directly adjacent to, or very near, toilets for convenience or for a lack of bathroom storage space. As a result, many toilet tools remain in view of residents and guests alike, creating an unsightly reminder of the less-than-inviting aspects of toilet care.

Up to the present, efforts to cover up the unsightly toilet tools have included toilet tool covers of adolescent design, such as a depiction of a giraffe's head, or of a shape still revealing the contents thereunder-as in a plunger or toilet brush. These prior contemplations fail to contribute to the aesthetic appearance of a bathroom while effectively masking the existence of a toilet tool. Other prior art discloses a bathroom furnishing, such as a pedestal or pillar, to house and conceal various toilet tools. However, this contemplation may compromise the space of small bathrooms by crowding it with the appearance, and existence, of additional furniture.

The following United States patents are herein incorporated by reference for their supporting teachings:

U.S. Pat. No. 5,984,100 is a decorative bathroom furnishing to be placed in a bathroom which provides concealed, sanitary storage of bathroom accessories and cleaning supplies, such as a toilet plunger, a toilet brush, a pair of rubber gloves, and a roll of toilet paper.

U.S. Pat. No. 6,038,709 is a toilet plunger holder and cover including a cylindrical base coextensive in height with the plunger elastomeric head and a cover for the with a narrow tubular portion that covers and is coextensive in length with the plunger handle.

U.S. Pat. No. 5,971,141 is a toilet accessory kit including a holder with receptacles at opposite ends for receiving and holding a toilet brush and a toilet plunger, respectively.

U.S. Des. Pat. No. 419,806 is an ornamental design for a toilet plunger cover emodying the general shape and appearance of a giraffe's head and neck.

U.S. Des. Pat. No. 383,935 is an ornamental design for a toilet plunger holder embodying the general shape and appearance of an ornate toilet plunger handle and base.

SUMMARY OF THE INVENTION

It has been recognized that it would be advantageous to develop a toilet tool cover that: 1) effectively hides or masks the existence of toilet tools, 2) contributes to the aesthetic appearance of a bathroom, and 3) does not crowd a small bathroom space with additional and unnecessary furniture.

Therefore, it is an advantage of the present invention to incorporate the use of flora integrating arrangements, whether of general plant or flower varieties, into a cover and base for toilet tools which can be placed at varying heights near a toilet, or upon the toilet reservoir, and which occupies very little space.

Additionally, the present invention provides for complete masking, or hiding, of a toilet tool, and generally contributes to the aesthetic appearance of a bathroom by taking on the appearance of a potted plant or flower arrangement.

Yet a further feature of the present invention is to provide a flora integrated cover for a toilet tool, which has a working portion and a handle extending therefrom, comprising a flower pot shaped base, shaped and designed to receive the working portion of the toilet tool, and a flora arrangement, shaped and designed to mount over the handle of the toilet tool. Uniquely, the flora arrangement is in a general appearance of plant leaves. Additionally, the flora arrangement is in a general appearance of a flower arrangement. Also, the flora arrangement is in a general appearance of a combined flower and plant arrangement. The toilet tool may be a toilet bowl brush where the working portion is a brush. The toilet tool may also be a toilet bowl plunger where the working portion is a bell, or suction cup. There also may be a hollow tube, positioned within the flora arrangement to releasably retain the handle within the tube, wherein the hollow tube is fixedly coupled to the flower pot shaped base, and wherein a bottom of the flower pot shaped base is open to allow the flora integrated cover to be placed over, and cover, the toilet tool.

Additional features and advantages of the invention will be set forth in the detailed description which follows, taken in conjunction with the accompanying drawings, which together illustrate by way of example, the features of the invention.

BRIEF DESCRIPTION OF THE DRAWINGS

In view of these objects which will become more readily apparent as the nature of the invention is better understood, the invention consists in the novel combination of parts hereinafter more fully described with like numbers corresponding to like elements between drawings, illustrated and claimed with reference to the appended drawings wherein:

DETAILED DESCRIPTION OF THE ILLUSTRATED EMBODIMENT(S)

Figure 1C:
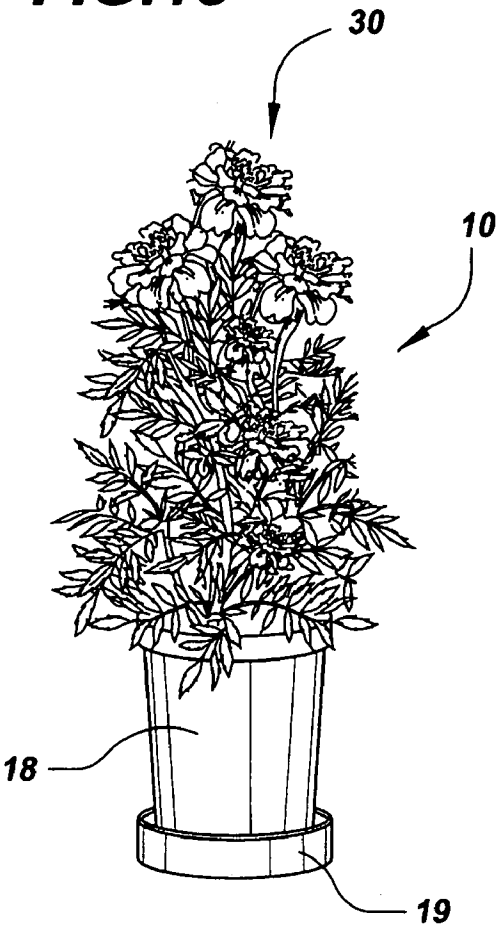
FIGS. 1*a–c* are perspective views of an illustrated embodiment of a flora integrated cover and base surrounding a toilet brush, including stages of assembly in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

The present invention is used in the normal arena in which toilet tools are employed, but where it may be advantageous to: 1) effectively hide or mask the existence of toilet tools, 2) contribute to the aesthetic appearance of a bathroom, and 3) prevent the crowding of a small bathroom space with additional and unnecessary furniture. The advantages over prior art lie principally in that the present invention accomplishes the aforementioned tasks by covering and masking the shape of the toilet tool contained thereunder, by taking on the appearance of a potted plant or flower, and by occupying a minimal space at any desired height of placement. It is noted that the use of the word flora is intended to convey the meaning that any type of vegetation, i.e. general plants, bushes, trees, herbs or flowers, can be used in the present invention.

Figure 1B:
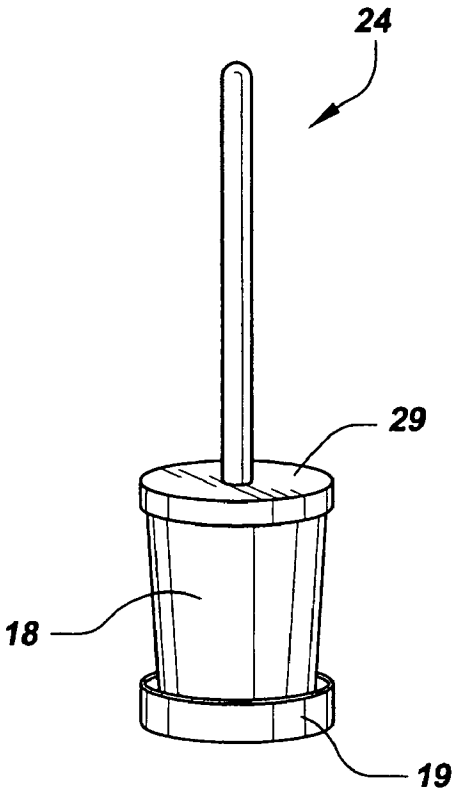
Figure 1A:
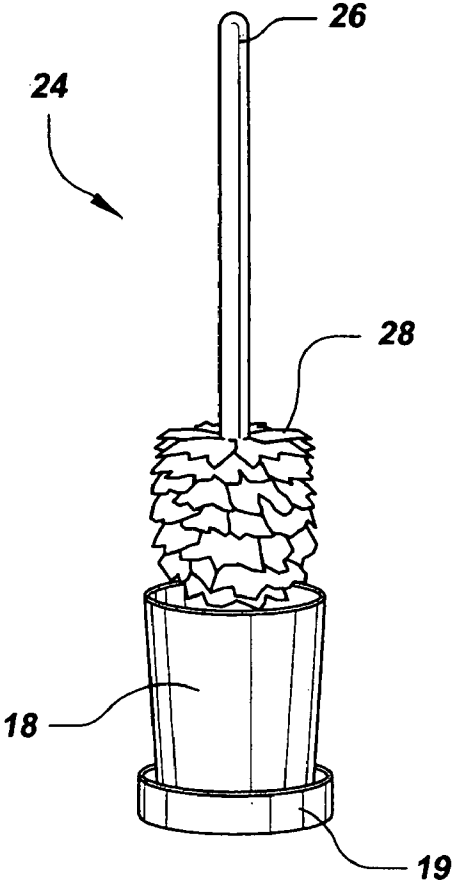

FIGS. 1*a–c* are perspective views of a flora integrated cover and base 10 releasably secured to, and covering, a toilet brush 24. In FIG. 1*a*, the toilet brush 24 is placed inside a decorative pot 18, which has a typical plant or flower pot shape and bottom plate 19. The toilet brush 24 is inserted into the pot 18, with the working portion of the toilet brush, or bristle end 28, first. Once inserted, a brush pot cover 29 is optionally placed over and around a brush handle 26 via a circular hole found in the brush pot cover 29, as shown in FIG. 1*b*. With the brush pot cover 29 in place, FIG. 1*c* shows a flora arrangement 30, of general plant or flower design adapted to the brush handle 26, as placed over the brush handle 26, thereby effectively hiding the brush handle 26 and bristles 28.

Figure 2C:
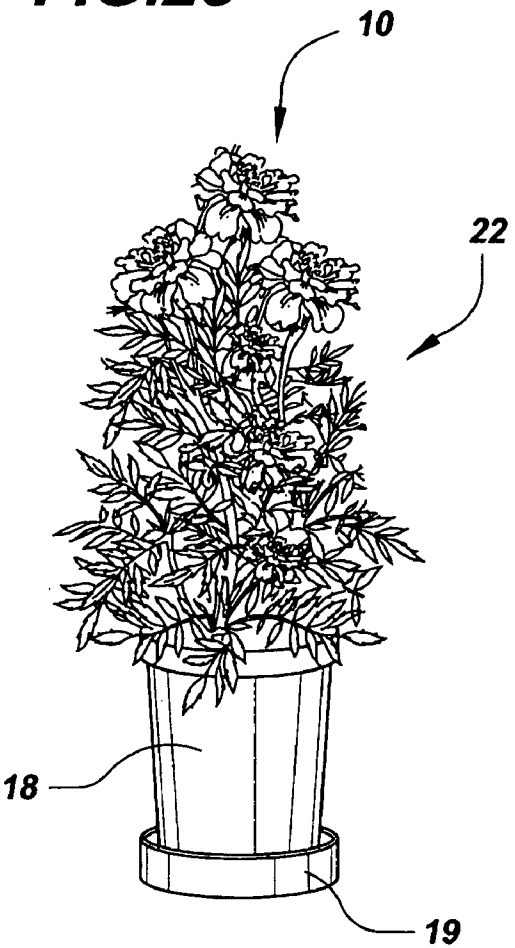
FIGS. 2*a–c* are perspective views of an illustrated embodiment of a flora integrated cover and base surrounding a toilet plunger, including stages of assembly in accordance with the present invention.
Figure 2B:
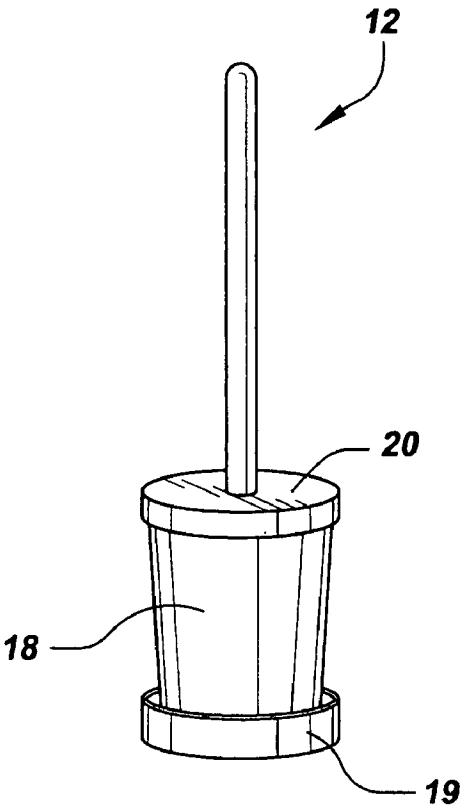
Figure 2A:
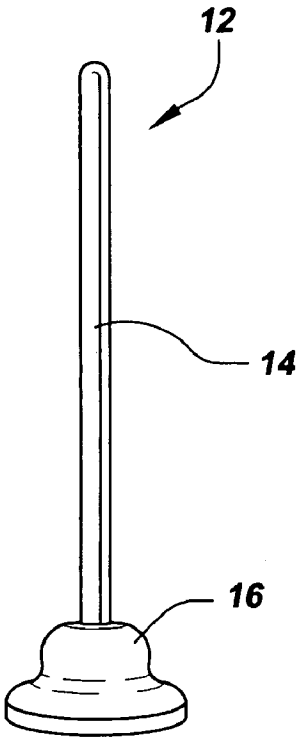

FIGS. 2*a–c* are representations of the type in FIGS. 1*a–c*, but as applied over a toilet plunger 12. It is noted that one skilled in the art will easily realize that the process of hiding the plunger 12 follows the process as outlined above in FIG. 1. In FIG. 2*a*, a rubber plunging end 16, the working portion of the plunger 12, is placed into a pot 18, and a plunger pot cover 20 is placed over and around a plunger handle 14 via a circular hole in the plunger pot cover 20 (FIG. 2*b*). With the plunger pot cover 20 in place, FIG. 2*c* shows a flora arrangement of general plant or flower design 22, adapted to the plunger handle 14, as placed over the brush handle 14, thereby effectively hiding the brush handle 26 and bristles 28.

Figure 3:
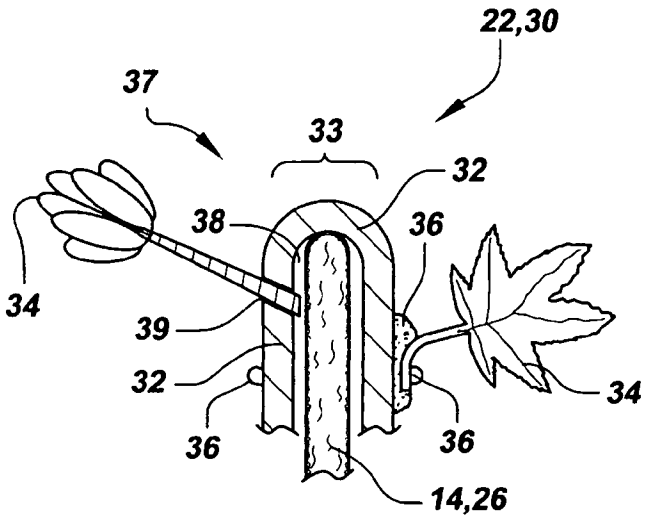
FIG. 3 is a cross sectional view of a flora integrated cover in place over a handle of a toilet tool, such as a toilet brush or plunger, in accordance with the present invention.

FIG. 3 depicts an illustrative cross-section of a flora arrangement 22,30 as placed over a plunger handle 14, or similar brush handle 26. A hollow tube 32 is utilized to support flora parts 34, such as leaves, flowers or buds, thereon. A continuous top cap 33 of the tube 32 rests on a top portion 37 of the handle 14,26. The flora parts 34 may be attached to the tube through any mechanical or other attachment means 36, such as, but not limited to, glue, wire or screws. In addition, a cavity 38 between the handle 14,26 and the tube 32 is shown to allow for easy placement of the flora arrangement 22,30 over the handle 14,26. An optional hole 39 is positioned in the tube 32 in order to hold the stems of flowers or leaves where the use of other attachment means 36 is unnecessary or impracticable.

Figure 4B:
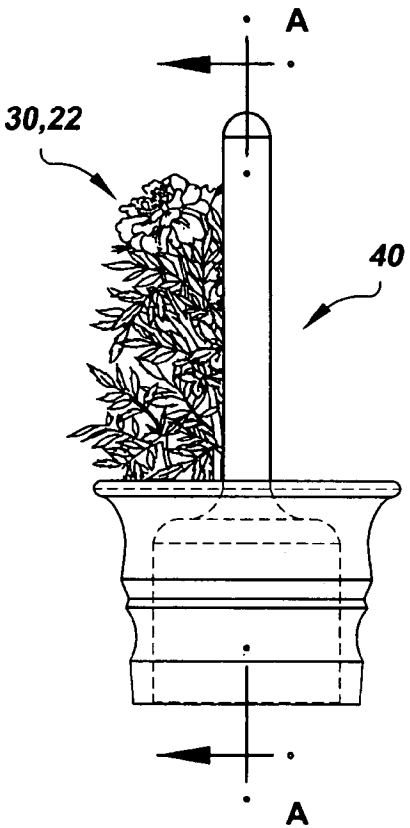
FIGS. 4*a–b* show side and cross sectional views of a unitary flora integrated cover with a hollow handle and hollow base, or pot, in accordance with the present invention.
Figure 4A:
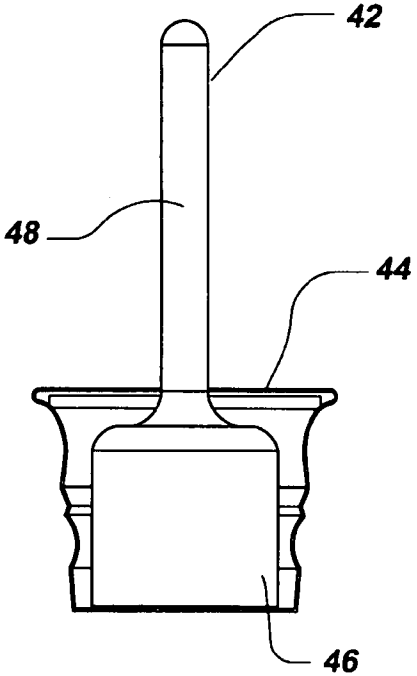

FIGS. 4*a* and 4*b* show side and cross sectional views of a unitary, one piece flora cover 40 in the design of a hollow base, or pot 44, and a hollow handle 42 extending from a central, or middle, portion of the pot 44. The unitary, one piece flora cover 40 is placed over toilet tools, such as a toilet brush or plunger, via hollow cavities in the handle 48 and base, or pot 46. A flora arrangement 22,30 is secured to, or rested over, the hollow handle 42 in order to effectively hide the shape and existence of a toilet tool resting thereunder. It is also contemplated in the alternative embodiment of FIGS. 4*a* and 4*b* to incorporate the bottom plate 19, as identified in FIGS. 1*a–c*, which is used to place the toilet tool thereon for protecting the floor from moisture. With the toilet tool in place, resting on top of the bottom plate 19, the one piece flora cover 40 may then be placed over the toilet tool.

VARIATIONS OF THE ILLUSTRATED EMBODIMENT(S)

Figure 5:
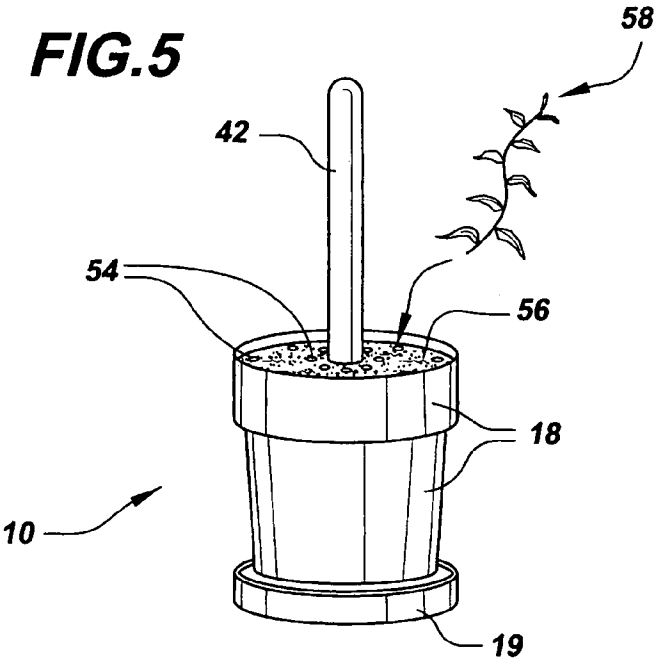

In FIG. 5, in addition to the elements discussed in the previous figures, there are illustrated alternative embodiments. As described before, the hollow handle 42 is attached to the decorative pot 18, which rest upon a bottom plate or bowl 19. However, attachment devices 54, represented by holes, are now added to allow a user to interchange artificial plants 58. This allows the user change the foliage appearance to match the season of the year or holidays. Additionally, there is added a top or surface layer 56 around the hollow handle 42 that resembles the appearance of dirt to provide a more realistic look of an actual potted plant.

Figure 6:
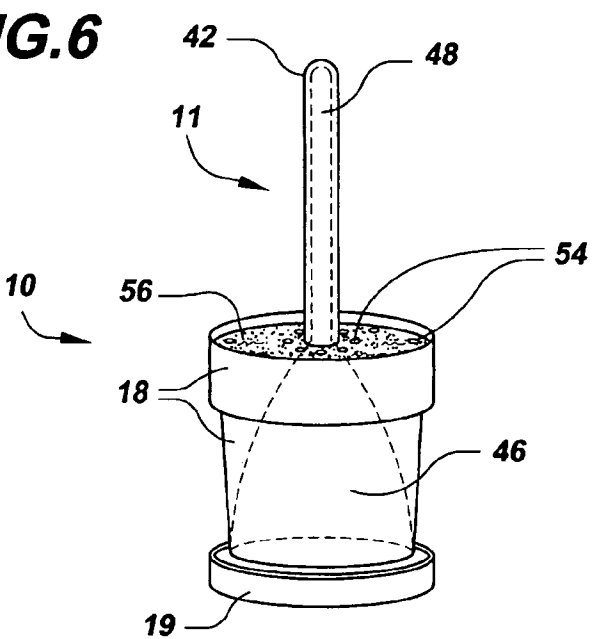
FIGS. 5, 6 and 7 are perspective views of flora integrated cover 10.

In FIG. 6 there is further illustrated in phantom lines an alternative embodiment for the hollow cavities in the handle 48 and pot 46. The purpose of the cavities, as stated throughout the detailed description is to effectively hide the shape and existence of a toilet tool resting therein. Again, the toilet tool is to be placed on the bottom plate 19, which allows collection of any water that is to be drained off of the tool.

Figure 7:
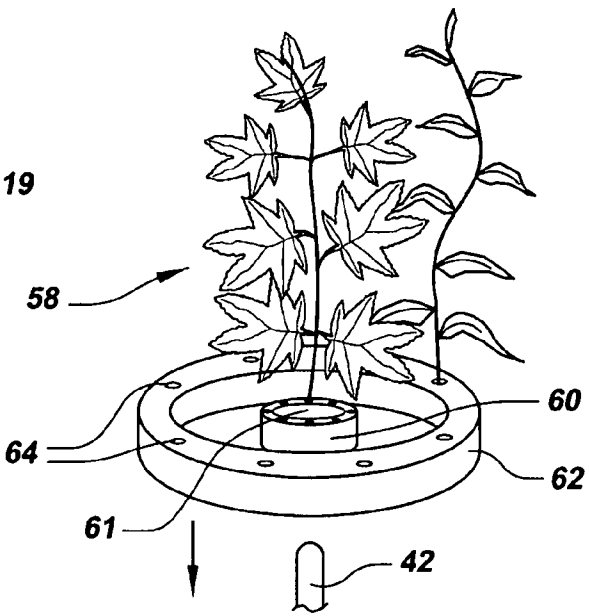

FIG. 7 illustrates an alternative embodiment of using a small interchangeable plant holder 60 and 62, illustrated in the form of two rings. Obviously, the holder could be any type of mechanical shape imaginable, including a single solid sheet, to satisfy the need of holding artificial flora around and hiding the appearance of the hollow handle 42. The holders 60 and 62 are illustrated to be placed over the hollow handle 42 and slid down to the representative dirt 56. There are attachment mechanisms 64 located on the holders 60 and 62 for affixing the plants 58 thereto. The attachment mechanisms are illustrated as holes, but could be most any attachment means such as glue, clips or springs. There is an opening 61 positioned on the holder 60 and 62 that is positioned and designed to allow the hollow handle 42 to slip through the holder 60 and 62.

Figure 8:
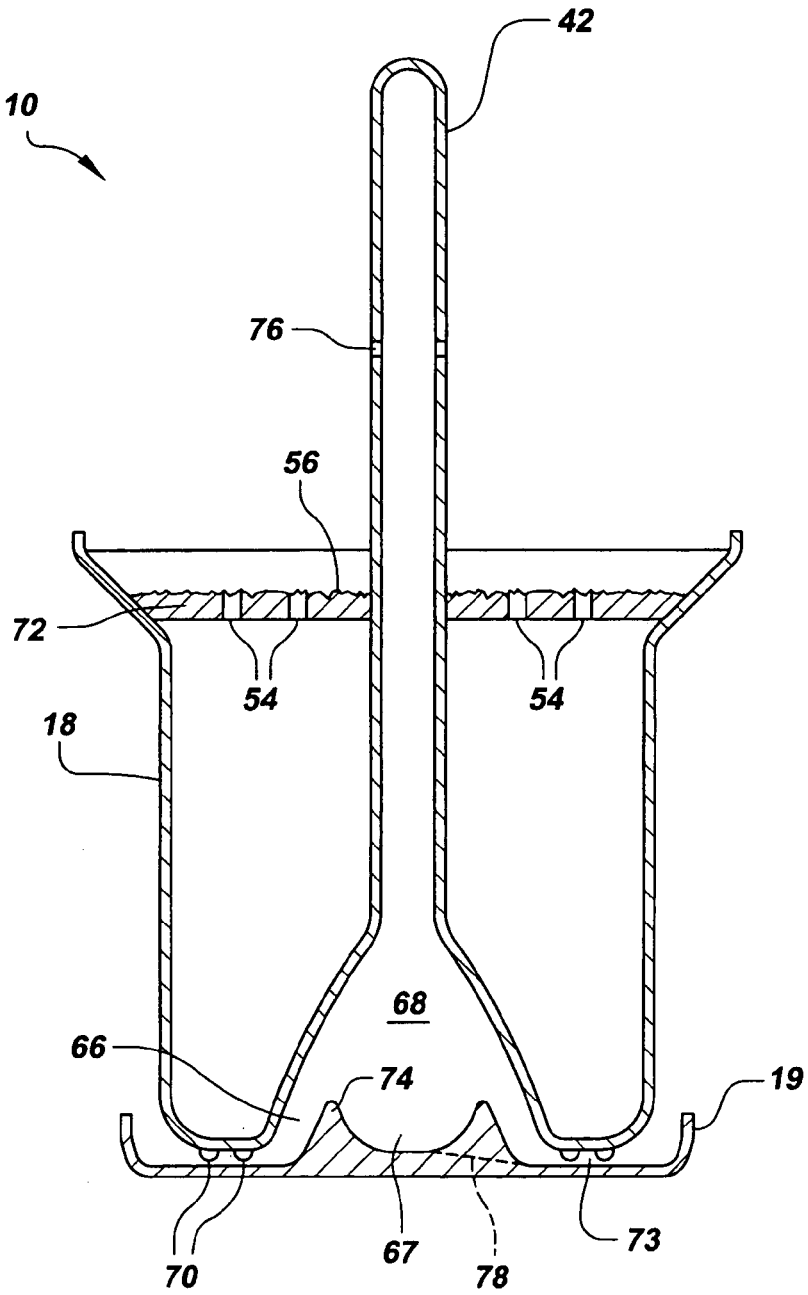
FIGS. 8, 9 and 10 are illustrated cross-sectional side views of the vegetative covering 10 of FIGS. 5, 6 and 7.
Figure 9:
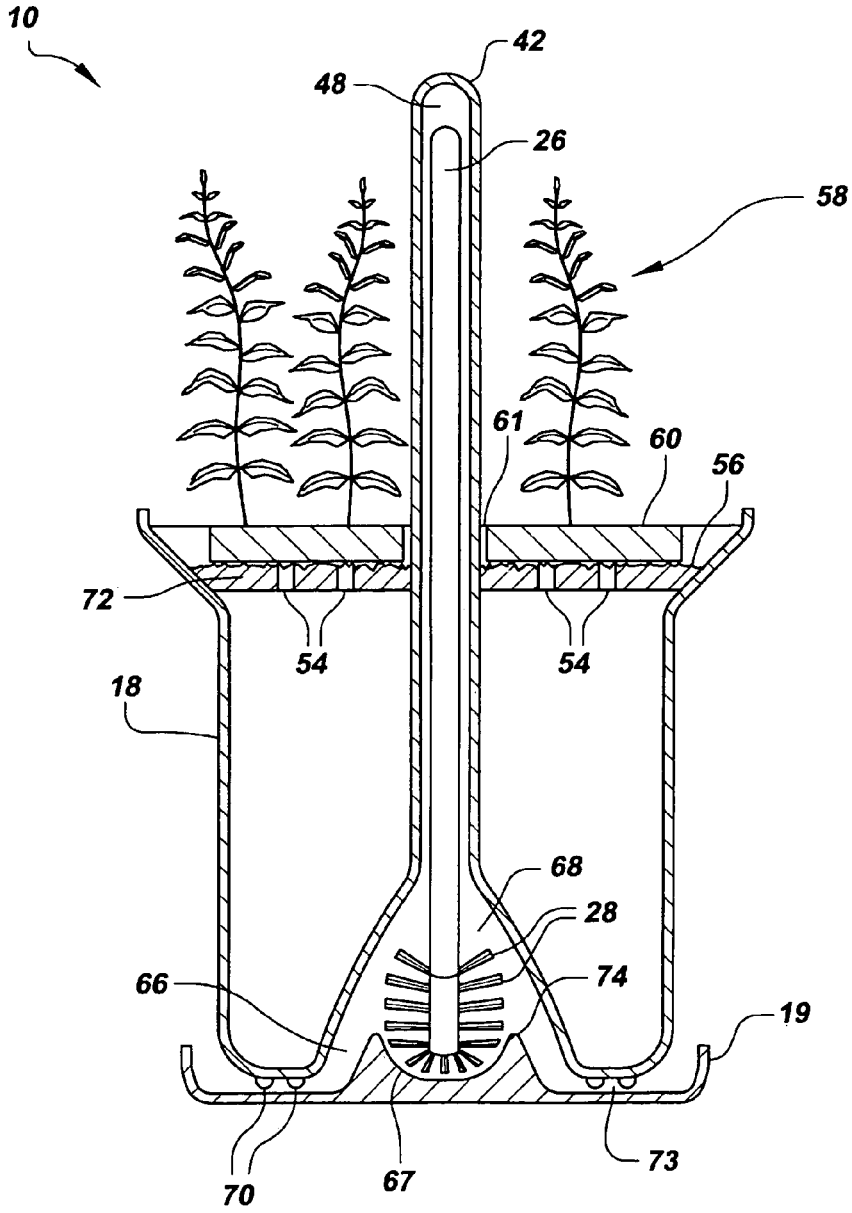
Figure 10:
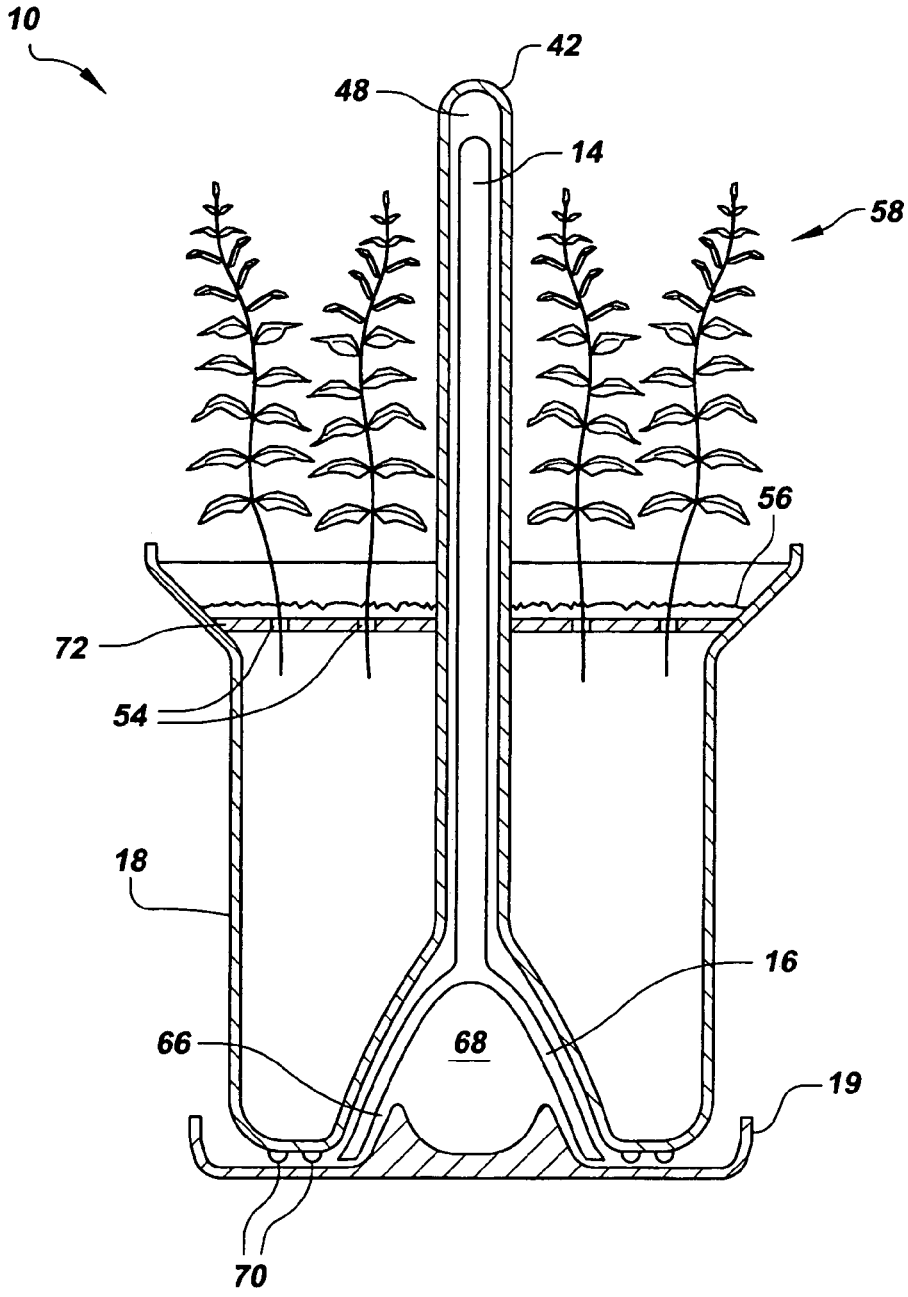

Referring to FIGS. 8, 9 and 10, there are illustrated cross-sectional side views of the vegetative covering 10 of FIGS. 5, 6 and 7. Specifically, there is a cavity 68 for storing tools therein. Cavity 66 is designed specifically to hold the cup of a plunger 16, as illustrated in FIG. 10. There is a brush cavity 67 that is designed to hold the brush 28 of a toilet tool, as illustrated in FIG. 9. The brush cavity 67 is further defined by brush lip 74 that is concentrically shaped to retain the brush 28 in a central position on the plate 19. Optional spacers 70, illustrated as two tabs, may be positioned at the bottom surface of the pot 18 to create an opening 73 positioned between the plate 19 and the pot 18. The opening 73 is designed to allow moisture, which is collected on the plate 19, to evaporate therefrom. Additionally, there may be optional vapor holes 76 positioned at various places on the handle to allow for moisture to escape from the plate 19. Moreover, there may also be moisture drains 78 positioned through the brush ridge 74 to allow for moisture to drain from the brush cavity 67. Finally, there is illustrated the support top 72 that is coupled to the pot 18. The top 72 has the top layer of material shaped to appear as dirt 56 and has artificial plant retainers 54 positioned through the top 72.

It is understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. For example, it is noted that there is no requirement for a particular means of securing the flora arrangements 22,30 to the hollow tube 32. As would be apparent to one skilled in the art, wire may be used to tie the flora parts 34 to the tube by wrapping or tying the wire around the flora parts 34 and also around the tube 32. Similarly, screws or glue may also be used to secure the flora parts 34 to the tube 32.

As depicted in FIG. 3, the tube 32 is contemplated with or without an optional continuous top cap 33 that extends over a top portion 37 of the plunger handle 14, or brush handle 26. In an absence of the optional continuous top cap 33, the plunger handle 14, or brush handle 26, may protrude above the top of the tube 32 (not shown). Where the flora parts 34 are comprised of a plastic material, the flora parts 34 may also rest on the tube 32 without any means of attachment. The rigidity of such plastic flora parts 34, where intertwined and placed atop the tube 32, or optional top cap 33, would support themselves.

In addition, variations on the density, type, and color of the flora arrangements 22,30 are contemplated. Leaves and flowers corresponding to differing trees, shrubs, flowers, or herbs are envisioned. Thus, while the present invention has been shown in the drawings and fully described above with particularity and detail in connection with what is presently deemed to be the most practical and preferred embodiment (s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A vegetation integrated cover for a tool, which has a working portion and a handle extended therefrom, comprising:

a container, comprising:

a base; and a cover, removably coupled to the base, configured to cover the working portion and the handle of the tool;

a plurality of vegetation holders, designed to position vegetation on the cover to substantially hide the appearance and shape of the cover, and wherein upon removal of the hidden cover, the working portion and the handle of the tool are exposed;

wherein the cover comprises a handle portion cover and a working portion cover, and wherein the vegetation holders are designed to removably retain vegetation on a top section of the working cover portion cover and along the handle portion cover; and wherein the handle portion cover includes vapor holes to allow moisture to evaporate therethrough.

2. The cover of claim 1, wherein the base comprises a cavity with a cavity lip protruding upwardly from the base, and configured to position the working portion of the tool in a central location of the base.

3. The cover of claim 2, wherein the working portion cover comprises an inner and an outer ring attached to the top thereof, and wherein the rings include vegetation holders.

4. The cover of claim 2, wherein the top of the working portion cover includes a layer of material designed to appear as dirt.

5. The cover of claim 4, further comprising at least one moisture drain passing through the cavity lip to allow moisture to drain from the cavity.

6. The cover of claim 1, wherein the cover comprises spacers positioned between the cover and the base, and configured to create an opening between the cover and the base to allow moisture to pass therethrough.

7. The cover of claim of claim 6, further comprising at least one moisture drain passing through the cavity lip to allow moisture to drain from the cavity.

8. A vegetation integrated cover for a tool, which has a working portion and a handle extended therefrom, comprising:

a container, comprising:

a base; and a cover, removably coupled to the base, configured to cover the working portion and the handle of the tool;

a plurality of vegetation holders, designed to position vegetation on the cover to substantially hide the appearance and shape of the cover;

wherein upon removal of the hidden cover, the working portion and the handle of the tool are exposed; and wherein the base comprises a cavity with a cavity lip protruding upwardly from the base, and configured to position the working portion of the tool in a central location of the base.

9. The cover of claim 8, wherein the tool is a toilet scrub brush.

10. The cover of claim 9, wherein the working portion of the toilet scrub brush fits inside the cavity.

11. The cover of claim 10, further comprising at least one moisture drain passing through the cavity lip to allow moisture to drain from the cavity.

12. The cover of claim 11, wherein the handle portion cover includes vapor holes to allow moisture to evaporate therethrough.

13. The cover of claim 8, further comprising at least one moisture drain passing trough the cavity lip to allow moisture to drain from cavity.

14. The cover of claim 13, wherein the handle portion cover includes vapor holes to allow moisture to evaporate therethrough.

15. The cover of claim of claim 8, wherein the handle portion cover includes vapor holes to allow moisture to evaporate therethrough.

16. A vegetation integrated cover for a tool, which has a working portion and a handle extended therefrom, comprising:

a container, comprising:

a base; and a cover, removably coupled to the base, configured to cover the working portion and the handle of the tool;

a plurality of vegetation holders, designed to position vegetation on the cover to substantially hide the appearance and shape of the cover;

wherein upon removal of the hidden cover, the working portion and the handle of the tool are exposed; and wherein the cover comprises spacers positioned between the cover and the base, and configured to create an opening between the cover and the base to allow moisture to pass therethrough.

17. The cover of claim 16, wherein the plunger surrounds the cavity lip.

18. The cover of claim 17, wherein the handle portion cover includes vapor holes to allow moisture to evaporate therethrough.

19. The cover of claim 16, wherein the handle portion cover includes vapor holes to allow moisture to evaporate therethrough.

20. The cover of claim 16, further comprising at least one moisture drain passing through the cavity lip to allow moisture to drain from the cavity.

* * * * *